United States Patent [19]

Inui et al.

[11] 4,455,355

[45] Jun. 19, 1984

[54] TIN-FREE STEEL CAN BODY

[75] Inventors: Tsuneo Inui, Tokuyama; Hitoshi Kuroda, Kudamatsu; Kenji Hizuka, Kudamatsu; Fumio Kunishige, Kudamatsu; Yoshikazu Kondo, Kudamatsu, all of Japan

[73] Assignee: Toyo Kohan Co., Ltd., Tokyo, Japan

[21] Appl. No.: 405,935

[22] Filed: Aug. 5, 1982

Related U.S. Application Data

[60] Continuation of Ser. No. 209,302, Nov. 21, 1980, abandoned, which is a division of Ser. No. 062,890, Aug. 1, 1979, abandoned.

[30] Foreign Application Priority Data

Mar. 30, 1979 [JP] Japan ..... 54-37084

[51] Int. Cl.[3] ..... B23K 9/16; B23K 9/24; B23K 35/38

[52] U.S. Cl. ..... 428/595; 220/75; 220/456; 428/623; 428/626; 428/629; 428/667

[58] Field of Search ..... 428/629, 595, 666, 667, 428/626, 623, 632, 633, 934, 935, 472, 689, 696; 220/75, 456; 148/31.5

[56] References Cited

U.S. PATENT DOCUMENTS

| | | | |
|---|---|---|---|
| 3,296,100 | 1/1967 | Yonezaki et al. | 204/41 |
| 3,532,608 | 10/1970 | Serra | 204/41 |
| 3,567,599 | 3/1971 | Carter, Jr. et al. | 204/41 |
| 3,574,069 | 4/1971 | Roberts, et al. | 204/29 |
| 3,679,554 | 7/1972 | Yamagishi et al. | 204/56 R |
| 3,755,091 | 8/1973 | Austin | 204/51 |
| 3,785,940 | 1/1974 | Yamagishi et al. | 204/56 R |
| 4,248,676 | 2/1981 | Uchida et al. | 204/41 |

FOREIGN PATENT DOCUMENTS

| | | |
|---|---|---|
| 53-58442 | 5/1978 | Japan . |
| 53-142335 | 12/1978 | Japan . |

OTHER PUBLICATIONS

*46th Metal Finishing Guidebook Directory*, Am. Business Press, Inc., pp. 471, 472, 474, 476 to 480, 555, 564, 566, 575, (1978).

*Primary Examiner*—Michael L. Lewis

*Attorney, Agent, or Firm*—Wenderoth, Lind & Ponack

[57] ABSTRACT

Tin-free steel having a first layer of metallic chromium on a steel base and a second layer of hydrated chromium oxide on the first layer, in which the atomic ratio of sulfur and the atomic ratio of fluorine to the sum of chromium, oxygen, sulfur and fluorine in the second layer are respectively not greater than 2.5 atomic percent and not greater than 10 atomic percent. This tin-free steel can be used for a nylon-adhered can body to be subjected to a hot-packing or retort treatment, since it has excellent lacquer adhesion after aging in hot water and under retort conditions.

3 Claims, 1 Drawing Figure

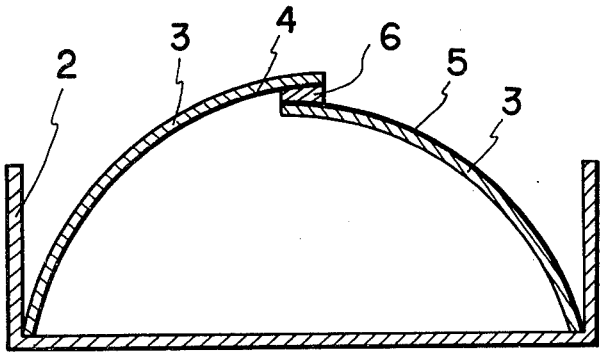
2
3
4
6
5
3

TIN-FREE STEEL CAN BODY

This application is a continuation of Ser. No. 209,302, filed Nov. 21, 1980, now abandoned, which is a division of Ser. No. 62,890, filed Aug. 1, 1979, now abandoned.

BACKGROUND OF THE INVENTION

The present invention relates to a tin-free steel (TFS) having a first layer, of metallic chromium, on a steel base, and a second layer, of hydrated chromium oxide, on the first layer, which can be used for a nylon-adhered can body requiring excellent lacquer adhesion after aging in hot water and under retort conditions.

Recently, lacquered TFS, rather than electrotinplates, has largely been used for manufacturing carbonated beverage cans and beer cans, since it exhibits lacquer adhesion which is superior to that exhibited by electrotinplates.

The ordinary metal can consists of the two can ends and a can body. In the case of lacquered TFS, the seaming of the can body is mainly carried out with nylon adhesive by using the Toyo Seam and Mira Seam methods. In these cases, the nylon adhesive is inserted not between the plain TFS surfaces, but between the lacquered TFS surfaces. An epoxy-phenolic type of lacquer is generally applied to the TFS. Therefore, the bonding strength of the adhered part of the lacquered TFS can body is shown by the weakest bonding strength among three interfaces: (1) between the metallic chromium layer and the hydrated chromium oxide layer, (2) between the hydrated chromium oxide layer and the lacquer film, and (3) between the lacquer film and the nylon adhesive. The nylon adhered part of the lacquered TFS can body not only has an acceptable bonding strength in a normal state, i.e. at room temperature and atmospheric pressure, but also a bonding strength which can satisfactorily withstand internal pressure caused by the contents of the can, such as beer and carbonated beverages.

However, when a can having a TFS can body seamed by nylon adhesive after lacquering is used as a container for foods such as fruit juices, which are immediately hot-packed after pasteurization at a temperature of 90°–100° C., or as a container for foods such as coffee, meat and fish, which are pasteurized by hot steam at a temperature above 100° C. in a retort after being packed in the can at about 100° C., the lacquer film may be peeled off from the TFS surface. Thus, a drop in the degree of vacuum in the can may occur due to partial loss of adhesion between the adhered parts of the can body, because the lacquer adhesion of conventional TFS becomes poor after aging in hot water and under retort conditions. Therefore, it is not possible to use conventional TFS cans seamed with nylon adhesive after lacquering, for pasteurizing the contents of the cans packed at high temperatures.

It is assumed that the deterioration of the lacquer adhesion of conventional TFS, after aging in hot water and under retort conditions, depends on the properties of the hydrated chromium oxide in the TFS.

In general, there are two well-known types of manufacturing processes for the production of commercial TFS. The first type is a one-step process in which metallic chromium and hydrated chromium oxide are formed in one operation by using one electrolyte composition. The second type is a two-step process in which first metallic chromium is formed by using one electrolyte composition as a chromium plating solution, and then hydrated chromium oxide is formed on the metallic chromium layer by using another electrolyte composition. In both types of processes, addition agents such as sulfuric acid and fluoride are added to the electrolyte compositions in amounts which result in incorporation of substantial amounts of sulfur and/or fluorine into the hydrated chromium oxide layer.

SUMMARY OF THE INVENTION

It is an object of the present invention to provide TFS which can be used for producing a nylon-adhered can body having excellent lacquer adhesion after aging in hot water and under retort conditions.

This object can be accomplished by restricting the amounts of sulfur and fluorine which are incorporated in the hydrated chromium oxide layer formed on the metallic chromium layer during electrolytic chromic acid treatment.

As discussed in more detail later on, various TFS samples having a first layer of 80–120 mg/m$^2$ of metallic chromium and a second layer of 12–20 mg/m$^2$, as chromium, of hydrated chromium oxide were prepared by varying the amounts of sulfuric acid and/or fluoride which were added to a chromic acid electrolyte, and the atomic ratios of each of sulfur and fluorine to the sum of the elements chromium, oxygen, sulfur and fluorine in the second layer were measured by using X-ray photoelectron spectrometer (XPS). At the same time the lacquer adhesion, (1) in the normal state, (2) after aging in hot water and (3) under retort conditions, of these TFS samples were tested. As a result, it was confirmed that the degree of lacquer adhesion on TFS restricted in the amounts of the incorporated sulfur and fluorine according to the present invention was superior to the degree of lacquer adhesion on conventional TFS.

BRIEF DESCRIPTION OF THE DRAWING

The drawing shows the manner in which a TFS specimen can be positioned to test it for lacquer adhesion under retort conditions.

DETAILED DESCRIPTION OF THE INVENTION

The steel base to be subjected to electrolytic treatment to produce the TFS of the present invention can be any cold rolled steel sheet customarily used in manufacturing electrotinplate and tin-free steel. Preferably, a type of steel base for electrotinplate, as set out in ASTM A 623-76 of 1977 (standard specification for general requirements for tin mill products), is employed as the steel base.

Preferably, the thickness of the steel base is from about 0.1 to about 0.35 mm.

The TFS for use in a nylon-adhered can body according to the present invention is characterized by a hydrated chromium oxide layer which satisfies the following formulae:

$$\text{Atomic \% of S: } \frac{S}{Cr + O + S + F} \times 100 \leqq 2.5 \text{ atomic \%}$$

$$\text{Atomic \% of F: } \frac{F}{Cr + O + S + F} \times 100 \leqq 10 \text{ atomic \%}$$

Namely, these formulae show that the atomic ratio of sulfur and the atomic ratio of fluorine to the sum of the four elements, chromium, oxygen, sulfur and fluorine, in the hydrated chromium oxide layer, are respectively not greater than 2.5 atomic percent and not greater than 10 atomic percent.

Although the atomic ratio of hydrogen, existing as a hydroxyl radical or bonded water, in the hydrated chromium oxide should be restricted, it is represented by the atomic ratio of oxygen because the quantitative analysis of hydrogen contained in hydrated chromium oxide is very difficult, and it is therefore apparent that the atomic ratio of hydrogen is indirectly thus restricted.

It is assumed that the bonding strength between the surface of the TFS and the lacquer film is mainly dependent on hydrogen bond between the hydroxyl radical or bonded water in the hydrated chromium oxide and the active radical in the lacquer film. If water or organic acids penetrate into the interface between the TFS and the lacquer film, the bonding strength decreases remarkably. Furthermore, under the heating conditions encountered during such operations as hot-packing or retort pasteurization, a remarkable deterioration of the bonding strength is also observed. Especially, if a high amount of sulfate radical is incorporated into the hydrated chromium oxide formed by an electrolytic chromic acid treatment, as in conventional TFS, the deterioration of the bonding strength is even more remarkably accelerated.

The reasons why the lacquer adhesion after aging in hot water and under retort conditions is deteriorated by the incorporation, into the hydrated chromium oxide, of the addition agents used in the electrolytic chromic acid treatment, such as sulfuric acid or fluoride, are considered to be as follows:

(1) The addition agent incorporated into the hydrated chromium oxide is a water-soluble component.

(2) The amount of hydroxyl radicals or bonded water in the hydrated chromium oxide layer, which are needed to form hydrogen bonds with the active radicals in the lacquer film to ensure lacquer adhesion, is decreased because such hydroxyl radicals or bonded water are substituted by the addition agents incorporated into the hydrated chromium oxide layer.

(3) The structure of the hydrated chromium oxide is substantially disturbed, or the coordinate bond in the hydrated chromium oxide is broken, since the sulfate radical incorporated into the hydrated chromium oxide has the same volume as trivalent chromium coordinated by a hydroxyl radical or bonded water with a coordination number of 6.

In the present invention, the reason that the allowable range of the atomic ratio of fluorine is wider than that of sulfur is considered to be that fluorine incorporated into the hydrated chromium oxide layer does not disturb the construction of the hydrated chromium oxide as much as does the sulfate radical, because fluorine has nearly the same volume as the hydroxyl radical or bonded water.

For the production of TFS having excellent lacquer adhesion even after aging in hot water and under retort conditions, the amount of addition agent added to the chromic acid electrolyte which is used for the formation of the hydrated chromium oxide layer should be decreased as much as possible below the amount used in producing conventional TFS, because as indicated above, the incorporation of addition agents into the hydrated chromium oxide layer causes a decrease in the content of hydroxyl radicals or bonded water in the hydrated chromium oxide layer, thus reducing the number of sites for hydrogen bond between the chromium oxide layer and the lacquer film. However, in order to efficiently produce TFS having a uniform metallic chromium layer and a uniform hydrated chromium oxide layer, it is indispensable to add at least one addition agent selected from the group consisting of sulfur compounds (e.g. sulfuric acid, phenolsulfonic acid or an ammonium or alkali metal sulfate, phenolsulfonate, sulfite or thiosulfate) and fluorine compounds (e.g. an ammonium or alkali metal fluoride, fluoborate or fluosilicate, or acid thereof, i.e. hydrofluoric acid, fluoboric acid, fluosilicic acid, ammonium bifluoride or an alkali metal bifluoride) to the chromic acid electrolyte solution.

In the case of a one-step process in which metallic chromium and hydrated chromium oxide are formed in one operation on the steel base, the amounts of the addition agents such as sulfuric acid and/or fluoride added to the electrolyte solution for the electrolytic chromic acid treatment should be suitably controlled according to the amount of chromic acid employed and in consideration of the current efficiency during the formation of the metallic chromium layer and hydrated chromium oxide layer.

In the present invention, if the atomic ratio of sulfur and that of fluorine in the hydrated chromium oxide layer are respectively above 2.5 atomic percent and above 10 atomic percent, the lacquer adhesion after aging in hot water and under retort conditions is not improved as compared to conventional TFS. For example, in order to produce TFS having a hydrated chromium oxide layer in which the amount of the incorporated sulfate radical is not greater than 2.5 atomic percent, based on the sulfur, the sulfuric acid should be added in an amount of less than 0.2 g/l to the electrolyte consisting of 20–150 g/l of chromic acid. However, this electrolytic solution, having such a low sulfate content, is not practical for the commercial production of TFS, because of the low current efficiency during the formation of metallic chromium. In such a case, therefore, it is desirable to add a suitable amount of, for example, a fluoride, to the electrolyte, instead of additional sulfuric acid, because fluorine incorporated in the hydrated chromium oxide has less deleterious effect on the lacquer adhesion after aging in hot water and under retort conditions than does the sulfate radical, as described above.

It is more desirable to use a fluorine compound (e.g. a fluoride) electrolyte, for example those disclosed in Japanese Patent Publication No. Sho 49-25537, without using any sulfur electrolyte.

If a fluorine compound alone is added to an electrolyte consisting of, for example, 20–100 g/l of chromic acid, the amount of fluorine compound should desirably be not greater than 1/20th the amount of chromic acid. Addition of 1/20th a fluorine compound in excess of this amount is not suitable for forming a uniform hydrated chromium oxide layer, although metallic chromium will be deposited on the steel base.

If TFS having a hydrated chromium oxide layer incorporating too much sulfate radical or fluorine is produced by using an electrolyte composition containing a correspondingly high amount of sulfate or fluoride, it is possible to reduce the amount of sulfate radical and fluorine which has been incorporated in the hydrated chromium oxide layer to 2.5 atomic percent and 10 atomic percent, respectively, by treating the TFS with hot water having a temperature above 50° C., preferably above 70° C., for at least one second, preferably 1–10 seconds, because the sulfate radical and fluorine may be easily substituted by hydroxyl radicals or bonded water. The use of steam having a temperature above 100° C. is also effective for this purpose, but, from the viewpoint of energy cost and heat resistance of equipment, the temperature should desirably not exceed 100° C.

In the case of a two-step process, chromium deposition is usually carried out by using a high concentration of chromic acid electrolyte containing a suitable amount of addition agents such as sulfuric acid. It is desirable to use a chromium plating solution having a low sulfuric acid content and a high fluoride content, because sulfuric acid and fluoride are incorporated into a thin hydrated chromium oxide layer formed on the metallic chromium layer during chromium deposition, i.e. during the first step. It is more desirable to use fluoride compounds alone as addition agent in the chromium plating solution, i.e. the first bath, because the sulfate radical has a more deleterious effect on the structure of the hydrated chromium oxide layer than fluorine. It is also preferable to (a) dissolve the hydrated chromium oxide, formed during chromium deposition, by immersing it in the chromium plating solution or (b) treat the hydrated chromium oxide layer with hot water of above 50° C., preferably above 70° C., or (c) remove the hydrated chromium oxide layer mechanically, before carrying out the second step of the two-step process.

For the second step, i.e. the formation of the hydrated chromium oxide layer after metallic chromium deposition, the same attention is needed as in the one-step process. In this second step, it is desirable to use a chromic acid solution containing one or more addition agents for the formation of the hydrated chromium oxide layer.

The lower limits for the atomic ratios of sulfur and fluorine in the hydrated chromium oxide layer are not critical to the present invention. As indicated above, it is indispensable to add at least one sulfur compound or fluorine compound to the chromic acid electrolyte solution in order to efficiently produce TFS having a uniform metallic chromium layer and a uniform hydrated chromium oxide layer, and therefore sulfur or fluorine is inevitably incorporated in the formed hydrated chromium oxide layer. Even if a chromic acid electrolyte, without the additon of a sulfur compound such as sulfate, is used for the formation of the hydrated chromium oxide layer, a trace of sulfur is detected in the formed hydrated chromium oxide layer, because a trace of sulfate is present in the chromic acid as follows: $CrO_3$ of reagent grade—below 0.02% of $SO_4$ (JIS K 8434); $CrO_3$ of industrial grade—below 0.1% of $SO_4$ (JIS K 1402). Also, since a trace of sulfate is included in the following fluorine compounds, a trace of sulfur is detected in the formed hydrated chromium oxide layer when these compounds are added to the chromic acid electrolyte: $KHF_2$ of reagent grade—below 0.02% of $SO_4$ (JIS K 8818); NaF of reagent grade—below 0.06% of $SO_4$ (JIS K 8821); HF of reagent grade—below 0.01% of $SO_4$ (JIS K 8819). Therefore a lower limit for the atomic ratio of sulfur in the hydrated chromium oxide layer will be, from a practical viewpoint, about 0.1 atomic %, because it depends on the amount of sulfate as impurity included in the chromic acid and fluorine compound which are used for the formation of the hydrated chromium oxide layer, although it should be, ideally, zero in the case of the formation of the hydrated chromium oxide layer by using a chromic acid electrolyte without any sulfur compound addition agent such as a sulfate.

A lower limit for the atomic ratio of fluorine in the hydrated chromium oxide layer depends on the amount of fluorine compound added to the chromic acid electrolyte and the treating conditions for the formation of a uniform hydrated chromium oxide layer, but it will be, from a practical viewpoint, about 0.5 atomic %, although this can be decreased to zero by treatment with hot water for a long time after the formation of the hydrated chromium oxide layer.

The amount of hydrated chromium oxide which is formed on the metallic chromium layer is desirably in the range of from about 8 to about 30 mg/m$^2$, as chromium. If the amount of hydrated chromium oxide is below 8 mg/m$^2$ as chromium, the lacquer adhesion after aging in hot water and under retort conditions is not improved, even if the atomic ratio of sulfur and the atomic ratio of fluorine in the formed hydrated chromium oxide layer are respectively not greater than 2.5 atomic % and not greater than 10 atomic %, because the metallic chromium layer is not sufficiently covered by the hydrated chromium oxide layer. If the amount is above 30 mg/m$^2$, the lacquer adhesion after a forming operation, such as drawing, becomes slightly poor.

The amount of metallic chromium which is formed on the steel base is desirably in the range of from about 50 to about 200 mg/m$^2$. If the amount of metallic chromium is below 50 mg/m$^2$, the corrosion resistance after lacquering and forming becomes poor. An amount above 200 mg/m$^2$ is not suitable for the high speed production of TFS.

The present invention is illustrated by the following examples, in which a duplex layer consisting of a lower layer of metallic chromium of 80–120 mg/m$^2$ and an upper layer of hydrated chromium oxide of 12–20 mg/m$^2$, as chromium, is formed on a cold rolled steel sheet having a thickness of 0.23 mm by various treating conditions.

EXAMPLE 1

A cold rolled steel sheet was treated by using an electrolyte composition consisting of 30 g/l of $CrO_3$ and 1.5 g/l of NaF in water under 20 A/dm$^2$ of cathodic current density at an electrolyte temperature of 30° C. The thus treated steel sheet was rinsed with water at room temperature and dried.

COMPARATIVE EXAMPLE 1

A cold rolled steel sheet was treated by using an electrolyte consisting of 80 g/l of $CrO_3$, 0.35 g/l of $H_2SO_4$ and 0.4 g/l of $HBF_4$ in water under 40 A/dm$^2$ of cathodic current density at an electrolyte temperature of 58° C. The thus treated steel sheet was rinsed with water at room temperature and dried.

EXAMPLE 2

A cold rolled steel sheet was treated by using an electrolyte composition consisting of 90 g/l of $CrO_3$ and 6 g/l of NaF in water under 40 A/dm$^2$ of cathodic current density at an electrolyte temperature of 50° C. After the current was turned off, the steel sheet was left in the electrolyte solution for 3–5 seconds to remove the very thin hydrated chromium oxide layer which had formed on the metallic chromium layer. Two separate specimens of the thus treated steel sheet were then further treated with this electrolytic solution diluted to one-third its original concentration and having added thereto either 0.05 g/l of 0.1 g/l of $H_2SO_4$, under 10 A/dm$^2$ of cathodic current density at an electrolyte temperature of 35° C., and were then rinsed with water at room temperature and dried.

COMPARATIVE EXAMPLE 2

The various conditions are the same as in Example 2, except that 0.2 g/l and 0.3 g/l of $H_2SO_4$ are added to the diluted electrolyte solution ($CrO_3$=30 g/l; NaF=2 g/l) used in the second electrolytic stage in Example 2.

EXAMPLE 3

A cold rolled steel sheet was treated by using an electrolyte composition consisting of 90 g/l of $CrO_3$ and 6 g/l of NaF in water under the same conditions as in Example 2. The thus treated steel sheet was then further treated with this electrolytic solution diluted to one-third its original concentration and having added thereto 0.5 g/l of $H_2SO_4$, under the same conditions as in Example 2, and was then treated for 3 seconds with hot water having a temperature of 75° C., and dried.

EXAMPLE 4

A cold rolled steel sheet was plated with metallic chromium by using an electrolyte composition consisting of 250 g/l of $CrO_3$ and 2.5 g/l of $H_2SO_4$ in water under 60 A/dm$^2$ of cathodic current density at an electrolyte temperature of 50° C. After the current was turned off, the steel sheet was left in the electrolyte solution for 3–5 seconds to remove the very thin hydrated chromium oxide layer which had formed on the metallic chromium layer. After rinsing with water, the chromium plated steel sheet was treated by using an electrolyte composition consisting of 50 g/l of $CrO_3$ and 0.7 g/l of $HBF_4$ in water under 8 A/dm$^2$ of cathodic current density at an electrolyte temperature of 40° C., and was then rinsed with water at room temperature and dried.

COMPARATIVE EXAMPLE 3

A cold rolled steel sheet was plated with metallic chromium by using the same electrolyte under the same conditions as in Example 4. After rinsing with water, the chromium plated steel sheet was treated by using an electrolyte composition consisting of 50 g/l of $CrO_3$ and 2 g/l of $HBF_4$ in water under the same conditions as in Example 4, and was then rinsed with water at room temperature and dried.

The atomic ratio of sulfur and the atomic ratio of fluorine to the sum of the elements, chromium, oxygen, sulfur and fluorine, in the hydrated chromium oxide layer of each resultant TFS prepared in Examples 1, 2, 3 and 4 and in Comparative Examples 1, 2 and 3 were measured by XPS, and the characteristics of each TFS were evaluated by the following test methods (1)–(3). The results are shown in the Table set forth below.

The measurement of chromium, oxygen, sulfur and fluorine in the hydrated chromium oxide layer by XPS was carried out at normal temperature in a vacuum. The adsorbed water existing on the surface of TFS has no effect on the measured values of each element, because it is easily desorbed in vacuum. The spectrum of chromium is obtained in a partly overlapped state of two spectra of trivalent chromium in the hydrated chromium oxide layer and of metallic chromium under the hydrated chromium oxide layer. Therefore, the measured value of trivalent chromium can be obtained by the separation of the overlapped spectra according to the intensity ratio of each spectrum. The composition ratio of each element in the hydrated chromium oxide layer is finally obtained by dividing the measured value of each spectrum, which is rectified by the sensitivity of each element, by the sum of each measured value, which is also rectified by the sensitivity of each element, of chromium, oxygen, sulfur and fluorine in the hydrated chromium oxide layer.

(1) Lacquer adhesion in a normal state in the part adhered with nylon adhesive:

Two pieces of the treated sample were prepared. One piece of the treated sample was baked at 210° C. for 12 minutes after coating with 60 mg/dm$^2$ of an epoxy-phenolic type lacquer, and the other piece was baked under the same conditions after coating with 25 mg/dm$^2$ of the same lacquer. The two differently coated sample pieces were each cut to a size of 5 mm×100 mm and bonded together by using a nylon adhesive having a thickness of 100 μm at 200° C. for 30 seconds under 3 kg/cm$^2$ of pressure by a hot press after pretreating at 200° C. for 120 seconds. The bonding strength of the assembly, in kg/5 mm, was measured by a conventional tensile testing machine.

(2) Lacquer adhesion after aging in hot water:

The assembly prepared by the method described in (1) above was peeled by a conventional tensile testing machine after the assembly was immersed in a 0.4% citric acid solution at 90° C. for 3 days. The holding strength of the assembly was measured in kg/5 mm.

(3) Lacquer adhesion under retort conditions:

Two pieces of the differently coated samples prepared by the method described in (1) above were each cut to a size of 70 mm in width and 60 mm in length, and were bonded so as to overlap each other by 8 mm in the longitudinal direction under the same conditions as described in (1). Ten assembled samples were prepared in this manner. Each assembled sample was curled to a radius of 100 mm, as for a can body, and then fixed in a channel of 70 mm in width, as shown in the drawing, in which one piece of TFS 3 having a thick lacquer film 4, and another piece of TFS 3 having a thin lacquer film 5, are adhered with nylon adhesive 6 on the edges, and the resultant adhered specimen is fixed in a channel 2 in a bent state. The ten fixed samples were set in a retort into which steam, heated to 125°–130° C. under a pressure of 1.6–1.7 kg/cm$^2$; was blown for 150 minutes or 300 minutes. The lacquer adhesion under the retort conditions was evaluated by the number of the samples which had peeled.

TABLE

| | | CHARACTERISTICS OF TREATED STEEL SHEET | | | | | | | | |
|---|---|---|---|---|---|---|---|---|---|---|
| | | Example 1 | Comparative Example 1 | Example 2 | | Comparative Example 2 | | Example 3 | Example 4 | Comparative Example 3 |
| Concentration of addition agent in $CrO_3$ electrolyte (g/l) | $H_2SO_4$ | 0 | 0.35 | 0.05 | 0.1 | 0.2 | 0.3 | 0.5 | 0 | 0 |
| | NaF | 1.5 | — | 2.0 | 2.0 | 2.0 | 2.0 | 2.0 | — | — |
| | $HBF_4$ | — | 0.4 | — | — | — | — | — | 0.7 | 2.0 |

TABLE-continued

| | | CHARACTERISTICS OF TREATED STEEL SHEET | | | | | | | | |
|---|---|---|---|---|---|---|---|---|---|---|
| | | Example 1 | Comparative Example 1 | Example 2 | | Comparative Example 2 | | Example 3 | Example 4 | Comparative Example 3 |
| Temperature of rinsing water and hot water (°C.) | | Room temp. | Room temp. | Room temp. | Room temp. | Room temp. | Room temp. | 75 | Room temp. | Room temp. |
| S and F in hydrated Cr oxide by XPS (Atomic %) | S | 0.5 | 4.1 | 1.3 | 1.9 | 2.6 | 3.5 | 1.2 | 0.8 | 0.6 |
| | F | 6.0 | 3.6 | 7.8 | 7.1 | 6.8 | 6.2 | 3.1 | 4.0 | 11.8 |
| Lacquer adhesion in normal state (kg/5 mm) | | 6.8 | 7.0 | 7.0 | 6.8 | 6.9 | 6.6 | 7.1 | 6.7 | 6.8 |
| Lacquer adhesion after aging in hot water (kg/5 mm) | | 3.1 | 0.3 | 2.9 | 2.8 | 0.7 | 0.2 | 2.8 | 2.9 | 0.4 |
| Lacquer adhesion under retort conditions (A/B)* | 150 min. | 0/10 | 8/10 | 0/10 | 0/10 | 3/10 | 4/10 | 0/10 | 0/10 | 1/10 |
| | 300 min. | 0/10 | 10/10 | 0/10 | 1/10 | 10/10 | 10/10 | 0/10 | 0/10 | 6/10 |

*A shows the number of peeled assemblies.
B shows the total number of test assemblies.

As can be calculated from Example 3 and Example 1, respectively, about 39% to about 46% of the lacquer adhesion is retained after aging in hot water.

As shown in the Table, there are very clear differences between the products of the Examples of the present invention and those of the Comparative Examples, in terms of the lacquer adhesion after aging in hot water and under retort conditions, although there is no substantial difference between these products in the lacquer adhesion in a normal state. It is apparent from these Examples that TFS having a hydrated chromium oxide layer in which the atomic ratio of sulfur and the atomic ratio of fluorine to the sum of the elements, chromium, oxygen, sulfur and fluorine, are restricted according to the present invention, exhibits remarkable effects in terms of improved lacquer adhesion after aging in hot water and water retort conditions.

We claim:

1. A can body of tin-free steel having a seam portion comprising said tin-free steel coated with a lacquer and a nylon adhesive, said tin-free steel comprising a first layer on a steel base, and a second layer on said first layer, said first layer being metallic chromium, said second layer being hydrated chromium oxide, the atomic ratio of sulfur in said second layer to the total chromium, oxygen, sulfur, and fluorine in said second layer being from 0.1 to 2.5%, the atomic ratio of fluorine in said second layer to the total chromium, oxygen, sulfur and fluorine in said second layer being from 0.5 to 10% said seam portion retaining a lacquer adhesion of about 39% to about 46% of its normal state lacquer adhesion after aging in hot water.

2. A can body according to claim 1, wherein, in the tin-free steel, the amount of metallic chromium in said first layer is from about 50 to about 200 mg/m$^2$.

3. A can body according to claim 1, wherein, in the tin-free steel, the amount of hydrated chromium oxide in said second layer is from about 8 to about 30 mg/m$^2$, calculated on the basis of chromium.

* * * * *